United States Patent [19]

Burton et al.

[11] 4,206,059

[45] Jun. 3, 1980

[54] PROCESS AND COMPOSITION FOR PREPARING WATER-EMULSIFIABLE METAL-WORKING LUBRICANT COMPOSITIONS

[75] Inventors: James R. Burton, Groves; Vernon W. Cantwell, Port Neches, both of Tex.

[73] Assignee: Texaco Inc., White Plains, N.Y.

[21] Appl. No.: 894,975

[22] Filed: Apr. 10, 1978

[51] Int. Cl.[2] ..... C10M 3/18

[52] U.S. Cl. ..... 252/18; 72/42; 252/41; 252/49.5

[58] Field of Search ..... 172/42; 252/41, 49.5, 252/18, 25

[56] References Cited

U.S. PATENT DOCUMENTS

| | | | |
|---|---|---|---|
| 2,697,072 | 12/1954 | Roden | 252/18 |
| 3,242,088 | 3/1966 | Bright et al. | 252/41 |

*Primary Examiner*—Andrew Metz

*Attorney, Agent, or Firm*—Thomas H. Whaley; Carl G. Ries; Bernard Marlowe

[57] ABSTRACT

This invention is directed to a composition and process for the preparation of water-emulsifiable metal-working lubricant compositions having improved storage stability and superior characteristics, preferably compositions for drawing, rolling and other applications in cold metal working operations.

2 Claims, No Drawings

PROCESS AND COMPOSITION FOR PREPARING WATER-EMULSIFIABLE METAL-WORKING LUBRICANT COMPOSITIONS

TECHNICAL BACKGROUND OF THIS INVENTION

The need for lubricants in the metal working operations such as drawing, rolling, and a variety of other similar applications is well established in the art. During metal working, friction between the die and the moving metal surfaces generates a great amount of heat; and unless an effective lubricant is present, sticking and scoring of the metal surfaces being worked occur, and excessive wear of the die takes place.

STATE OF THE ART

U.S. Pat. No. 2,697,072 discloses emulsion-type lubricants comprising an aqueous emulsion of a mineral oil of lubricating viscosity containing a major amount of solid fillers such as calcium carbonate, a minor amount of talc, oyster shells and an inert clay, etc. In addition, a small amount of oil-soluble animal fat soap, such as sodium woolate is also disclosed in this patent.

The process of this patent is characterized by several shortcomings. They are: (1) a relatively complicated and time-consuming process of manufacture, (2) the lubricant products have poor storage or shelf life, (3) the emulsion tends to separate and is very difficult to reemulsify, and (4) the appearance of the separated lubricant products is unattractive to the potential buyer. A real need exists for a simplified manufacturing process which provides an improved lubricant and which eliminates certain costly steps without adversely affecting the properties of the lubricant product.

DESCRIPTION OF THE INVENTION

The simplified process of this invention does not require the dehydration which normally follows the saponification of the fat and provides a superior method of incorporating the sodium carboxy lower-alkyl cellulose. The stability or shelf life of the product and its resultant appearance are also improved.

In one favored process embodiment, a reaction vessel (equipped with means of heating, cooling, stirring as well as means of circulating under back pressure) is charged with the hereinafter designated components of the lubricant in the sequence and proportions set forth below:

(a) from 7.5 to 10.0 parts by weight of animal fat (e.g., wool fat) is heated to at least the melting point of the fat with stirring; and approximately from 0.3 to 0.5 parts by weight sodium carboxylowrealkyl cellulose is added until a uniform blend of melted fat and sodium carboxyloweralkyl cellulose is obtained.

(b) as soon as the fat-sodium carboxyloweralkyl cellulose stirred blend is obtained, it is circulated through a shearing device which is adjusted to provide a back pressure ranging from 20 to 60 psig for 30 to 45 minutes, at a tempeature of from 100° F. to 180° F. Approximately 12.6 to 35.3 parts by weight of mineral oil (a naphthenic oil of 310 SUS viscosity at 100° F.) is added and the batch is allowed to circulate at 100° F. to 180° F. for a period of ½ to 1 hour.

(c) at 180° F. to 205° F. at least a stoichiometric amount of sodium hydroxide in water is added to the circulating and stirred system until saponification of the fat takes place. Then from 0.4 to 1.0 parts by weight of alkali is added to the stirred system to give from 0.2 to 0.5% by weight of free alkali (as sodium hydroxide).

(d) from 2.0 to 3.0 parts by weight of ethoxylated alkylphenol and from 0.2 to 0.4 parts by weight of optional components such as deodorants, and 0.5 to 1.0 parts by weight additional water are added to the stirred, circulating batch.

(e) The circulating is stopped and from 50 to 60 parts by weight of solid filler (such as calcium carbonate) is added to the stirred mixture and allowed to cool to 140° F. to 160° F. for from 1 to 4 hours.

(f) After the solid filler has been added, from 1 to 6 parts by weight of water is added and circulation is resumed at from 20 to 60 psig for a period of time ranging from 1 to 4 hours. Then the stirred circulating batch is allowed to cool to between 100° F. to 130° F.

(g) At 120° F. circulation is stopped, the water content is adjusted to 1.0 to 8.0 percent by weight and the worked penetration is adjusted to 290 to 340. The superiority of the novel process of this invention over the art can be seen by the comparable art process and the applicants' inventive process which follows.

In order to demonstrate the superiority of the claimed process of this application over the prior art process disclosed by U.S. Pat. No. 2,697,072, the two processes were run side by side. It will be noted that the process of the invention charges the animal fat to the reaction kettle with stirring and heating and sodium carboxymethyl cellulose, in dry form, is added slowly while the melted fat is circulated at a back pressure of 20–60 psig - the prior art process being carried out without circulation of the fat and the sodium carboxymethyl cellulose is added as a blend (gel) in water which must be prepared in an auxiliary mixing vessel. It will also be noted that the process of this invention omits the dehydration step of the prior art and also does not include antifoamer.

These Tables demonstrate the superiority of the lubricants of the inventive process over those of the aforementioned prior art.

Throughout this disclosure unless specified otherwise, all parts are by weight and all percents are by weight.

TABLE I

| Identification | This Invention | Prior Art |
|---|---|---|
| Composition Parts by Weight | | |
| Na Soap of Wool Grease | 5.0 | 5.0 |
| Free Alkali as NaOH | 0.2 | 0.2 |
| Water | 2.5 | 2.5 |
| Surfonic N-40* | 2.0 | — |
| Pine Tar | 0.3 | 0.3 |
| Driscose** | 0.5 | 0.5 |
| Calcium Carbonate | 54.2 | 54.2 |
| 300 Pale Oil | 32.6 | 34.6 |
| Non-Saponifiables from Wool Grease | 2.7 | 2.7 |
| Antifoaming Agent | — | 20 ppm |
| Totals | 100.0 | 100.0 |

*Ethylene oxide alkyl phenol adduct containing 4 moles of ethylene oxide per mole of phenol.
**Sodium carboxymethyl cellulose.

TABLE II

| | Test Results | |
|---|---|---|
| | This Invention | Prior Art |
| Appearance Visual | Whitish Soft Tan Paste | |
| Test Results | | |
| Penetrations Undisturbed | 253 | 290 |

TABLE II-continued

| | Test Results | |
|---|---|---|
| | This Invention | Prior Art |
| Worked | 293 | — |
| Emulsibility | OK* | OK* |
| Filler Settlement | OK** | OK** |
| Tests after Ambient Storage | | |
| After 1 Month:Appearance | OK*** | OK*** |
| Penetrations, Undisturbed | 252 | — |
| Worked | 300 | 300 |
| Emulsibility | OK | OK |
| Filler Settlement | OK | Fail (40 cc) |
| After 3 Months:Appearance | OK | Trace Oil Separation |
| Penetrations, Undisturbed | 242 | 263 |
| Worked | 298 | 327 |
| Emulsibility | OK | OK |
| Filler Settlement | OK | Fail (40 cc) |
| After 5 Months:Appearance | OK | Slight Oil Separation |
| Penetrations, Undisturbed | 246 | 270 |
| Worked | 299 | 359 |
| Emulsibility | OK | OK |
| Filler Settlement | OK | Fail (40 cc) |
| After 12 Months:Appearance | OK; slight crust | ¼ in. oil separation |

*Emulsify readily and completely.
**None after 24 hours from 2:1 (water to compound) emulsion.
***Little or no change from original. No oil separation.

CONTROL EXAMPLE I - DRAWING LUBRICANTS PREPARED BY THE PRIOR ART PROCESS (1) A blend containing 7.7% of sodium carboxymethyl cellulose in hot water is prepared in a suitable mixing vessel equipped with an adjustable type heavy mixer. This blend is put aside for use in step (7).

(2) A reaction vessel equipped with heating, cooling and stirring means is charged with 7.5 parts of the wool fat component and 4 parts of mineral oil. A sodium hydroxide aqueous solution and a small portion of water are added to saponify the wool fat by mixing for 3 hours at 180° F. to 200° F.

(3) Also added are 20 parts per million of a commercial silicone defoamer (only in the control example but not in the experimental example). The batch is heated to 290° F. to 300° F. to dehydrate the saponification mixture and the sodium woolate soap is then conditioned in the reaction kettle by stirring for 2 hours at 290° F. to 300° F.

(4) The remaining mineral oil (30.6 parts) is worked into the reaction mixture at about 285° F. (5) A control test is made for free alkali content and the batch is adjusted to a range of 0.45 to 0.55 percent by weight free alkali computed as sodium hydroxide.

(6) The batch temperature is adjusted to 280 ° F. to 285° F., the heat turned off, and the batch is cooled gradually while adding the calcium carbonate with stirring. A small amount of water is added while adding the calcium carbonate.

(7) As the batch cools to 160° F., pine tar is added slowly and then methyl cellulose (which is in the form of a gel prepared in step 1).

(8) Stirring and cooling of the batch is continued to 110° F.

A sample is taken for control testing for water content and unworked penetration. The water range of the batch is adjusted to 4.0 to 8.0 percent by weight.

In experimental Example 2 which follows, the procedure of Example I is followed except that the melted fat is circulated at a back (or shear) pressure of 20–60 psig as the sodium carboxymethyl cellulose is added in dry form (i.e., step 1 supra is omitted). No anti-foamer is used and no dehydration is carried out (i.e., step 3 supra is omitted) in carrying out Example 2.

The compositions of the materials added in Examples 1 and 2 are as tabulated in Table I.

EXAMPLE 2

Summary of manufacturing procedures for the improved lubricant for metal drawing applications.

(1) Charge 9 parts of the wool fat component to the stirred reaction kettle and start heating. Slowly add 0.5 parts of sodium carboxymethyl cellulose component and blend it into the wool fat.

(2) As soon as the wool fat is melted, the circulating system is started and the batch is passed through the circulating system from the kettle bottom through an outside line and returned to the top of the kettle through a valve adjusted to provide a shear (back) pressure of 20 psig.

(3) Add 11.7 parts by weight of the mineral oil utilized in Example 1 to the stirred reaction kettle while continuing the circulation and heat the kettle to 180° F. to 205° F. (310 SUS vis/100° F. naphthenic oil).

(4) At a temperature of at least 180° F., add 0.60 parts of 49% aqueous solution of sodium hydroxide and 2 parts water to the batch and saponify the mixture at a temperature of at least 180° F. to 205° F. for a total of 3 hours.

(5) Run a control test to determine the free alkali content of the batch and adjust it to a range of 0.2 to 0.5 percent by weight of free alkali computed as sodium hydroxide.

(6) Add 0.3 parts of the pine tar, 2.0 parts of ethoxylated nonyl phenol and 0.5 parts of water to the batch while continuing to stir and circulate the batch to obtain optimum mixing.

(7) The circulation is stopped; and 54.2 parts by weight of calcium carbonate is added with stirring, while the batch temperature is cooled gradually to 140° F. to 160° F.

(8) After all of the calcium carbonate has been added, add one percent water and start circulating the batch at 20 to 60 psig shear pressure at a temperature ranging from 140° F. to 170° F. for one hour, then cut off the heating and allow the batch to cool at circulation, shearing and stirring to 120° F.

(9) At 120° F., circulation stops and control tests are run for water content and worked penetration. The batch is adjusted to a water content ranging from 1.0 to 8.0% and a worked penetration range of 290 to 340.

As can be seen by Table I supra, the composition of the prior art represented by U.S. Pat. No. 2,697,072 and the composition in the claimed invention are virtually the same except for the addition of 2 wt % of ethoxylated nonylphenol and the omission of the small quantity of commercial antifoamer in claimed invention. Table I supra discloses the components utilized in the lubricating composition. Table II shows a side by side comparison of the physical characteristics of the prior art compound with those of the applicants' claimed invention. As can be seen, comparable or better than comparable results and much better storage stability results are obtained by the novel invention process which also requires much less time and care in the manufacturing process.

This invention is applicable both to the inventive process and to the lubricants produced therein. For instance, the novel process provides a simplified technique to readily blend the animal fat with sodium carboxymethyl cellulose requiring only one reaction kettle for all of the components of the charge. This novel manufacturing procedure is contrary to the prior art, including the recommendations set forth in the manufacturer's suggested procedure. The novel invention eliminates the dehydration step and the need for antifoaming agent and the need for an auxiliary mixing vessel. The final improvement in the inventive process is the general utilization of a circulation device which permits shearing at back pressures of 20 to 60 psig. This procedure results in better homogeneity of the grease components than obtained in the prior art. This is the major advantage of the inventive process. A compositional aspect of this invention is the production of a storage stable water emulsifiable drawing lubricant which does not separate even after considerable periods of storage time.

What is claimed is:

1. An improved process for preparing water-emulsifiable metalworking lubricant compositions of improved storage stability and superior characteristics comprising:

(a) charging to a reaction vessel from 7.5 to 10.0 parts by weight of animal fat and heating to at least the melting point of the fat with stirring and further adding from 0.3 to 0.5 parts by weight of dry sodium carboxyloweralkyl cellulose to said fat until a uniform blend of melted fat and sodium carboxyloweralkyl cellulose is obtained;

(b) circulating the blend of step (a) through a shearing device at a shear pressure of from 20 to 60 psig for from 30 to 45 minutes at a temperature of from 100° F. to 180° F. and further adding from about 12.6 to 35.3 parts by weight of mineral oil to said blend with continued circulation of the batch at from 100° F. to 180° F. for from ½ to 1 hour;

(c) adding to the circulating and stirred composition of step (b) at a temperature of from 180° F. to 205° F. at least a stoichiometric amount of sodium hydroxide in water to effect saponification of the fat and further adding from 0.4 to 1.0 part by weight of alkali to give from 0.2 to 0.5 percent by weight of free alkali as sodium hydroxide;

(d) adding to the circulating and stirred composition of step (c) from 2.0 to 3.0 parts by weight of ethoxylated alkylphenol, from 0.2 to 0.4 parts by weight of a deodorant and from 0.5 to 1.0 part weight of additional water;

(e) stopping the circulation and adding from 50 to 60 parts by weight of inert filler while stirring and allowing the stirred mixture to cool to 140° F. to 160° F. for from 1 to 4 hours;

(f) further adding from 1 to 6 parts by weight of water to the stirred composition of step (e) and resuming circulation at a pressure of from 20 to 60 psig for from 1 to 4 hours and allowing the stirred circulated batch to cool to between 100° F. to 130° F. and;

(g) stopping the circulation when the batch reaches 120° F., adjusting the water content to from 1.0 to 8.0 percent by weight and adjusting the worked penetration to from 290 to 340.

2. The water emulsifiable metalworking lubricant composition prepared by the process of claim 1.

* * * * *